US011067319B2

(12) United States Patent
Ray, Jr. et al.

(10) Patent No.: US 11,067,319 B2
(45) Date of Patent: Jul. 20, 2021

(54) HEAT EXCHANGER WITH MULTIPLE CONDUITS AND VALVE CONTROL SYSTEM

(71) Applicant: Johnson Controls Technology Company, Auburn Hills, MI (US)

(72) Inventors: Elton D. Ray, Jr., Wichita, KS (US); Tom R. Tasker, Andover, KS (US); Eugene G. Sommerhauser, Clearwater, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 320 days.

(21) Appl. No.: 15/935,948

(22) Filed: Mar. 26, 2018

(65) Prior Publication Data

US 2019/0271493 A1 Sep. 5, 2019

Related U.S. Application Data

(60) Provisional application No. 62/638,835, filed on Mar. 5, 2018.

(51) Int. Cl.

| | |
|---|---|
| ***F25B 41/04*** | (2006.01) |
| ***F25B 41/20*** | (2021.01) |
| ***F25B 13/00*** | (2006.01) |
| ***F25B 49/02*** | (2006.01) |
| ***F25B 39/02*** | (2006.01) |

(Continued)

(52) U.S. Cl.

CPC ..... *F25B 41/20* (2021.01); *F25B 5/02* (2013.01); *F25B 6/02* (2013.01); *F25B 13/00* (2013.01); *F25B 39/028* (2013.01); *F25B 49/022* (2013.01); *F25B 2600/2511* (2013.01); *F25B 2600/2515* (2013.01); *F25B 2700/171* (2013.01); *F25B 2700/19* (2013.01); *F25B 2700/21* (2013.01)

(58) Field of Classification Search

CPC .. F25B 5/02; F25B 6/02; F25B 39/028; F25B 2600/2511; F25B 2700/171

See application file for complete search history.

(56) References Cited

U.S. PATENT DOCUMENTS 4,876,858 A * 10/1989 Shaw ..... F24F 3/1405 62/93

5,050,396 A * 9/1991 Ohkoshi ..... F25B 5/00 62/160

(Continued)

FOREIGN PATENT DOCUMENTS

WO WO-2018020654 A1 * 2/2018 ..... F25B 5/02

OTHER PUBLICATIONS

JP 4272224 (English Translation) (Year: 2009).*

*Primary Examiner* — Jonathan Bradford

(74) *Attorney, Agent, or Firm* — Fletcher Yoder, P.C.

(57) ABSTRACT

A heat exchanger system that includes a heat exchanger that includes a plurality of circuits wherein the heat exchanger is configured to exchange heat between a refrigerant and a working fluid. The heat exchanger system also includes a valve configured to fluidly couple a circuit of the plurality of circuits to a flow path of the refrigerant. Further, the heat exchanger system includes a controller that is configured to receive feedback indicative of an operating parameter of the heat exchanger system and actuate the valve based on the operating parameter.

21 Claims, 7 Drawing Sheets

(51) Int. Cl.
*F25B 5/02* (2006.01)
*F25B 6/02* (2006.01)

(56) References Cited

U.S. PATENT DOCUMENTS 6,138,919 A * 10/2000 Cooper ..... F25B 5/02 237/2 B
6,381,974 B1 * 5/2002 Hwang ..... F25B 13/00 165/286
8,359,882 B2 1/2013 Al-Eidan
10,415,860 B2 * 9/2019 Tanaka ..... F25B 30/02
10,816,242 B2 * 10/2020 Tanaka ..... F25B 39/04
2001/0048031 A1 * 12/2001 Noro ..... F24H 4/04 237/2 B
2006/0288713 A1 * 12/2006 Knight ..... F24F 3/153 62/176.6
2011/0219797 A1 * 9/2011 Taguchi ..... B60H 1/3208 62/129
2012/0042686 A1 * 2/2012 Oshitani ..... F04F 5/54 62/500
2012/0227426 A1 * 9/2012 Deaconu ..... F25B 1/10 62/115
2014/0123693 A1 * 5/2014 Shimazu ..... F25B 49/00 62/115
2014/0260392 A1 9/2014 Hawkins et al.
2015/0300744 A1 * 10/2015 Goel ..... F25B 39/028 165/166
2015/0316297 A1 * 11/2015 Prins ..... F25B 5/02 62/115
2015/0362263 A1 * 12/2015 Wang ..... F28F 27/02 165/100
2017/0130996 A1 * 5/2017 Hatanaka ..... F24F 11/89
2017/0191718 A1 * 7/2017 Kohler ..... F25B 41/062
2017/0314820 A1 11/2017 Groskreutz et al.
2017/0336119 A1 * 11/2017 McDonough ..... F25B 25/005

* cited by examiner

HEAT EXCHANGER WITH MULTIPLE CONDUITS AND VALVE CONTROL SYSTEM

CROSS-REFERENCE TO RELATED APPLICATION

This application is a Non-Provisional application claiming priority to U.S. Provisional Application No. 62/638,835, entitled "HEAT EXCHANGER WITH MULTIPLE CIRCUITS," filed Mar. 5, 2018, which is hereby incorporated by reference in its entirety for all purposes.

BACKGROUND

The present disclosure relates generally to heating, ventilation, and air conditioning systems (HVAC) and, more particularly, to a heat exchanger for a HVAC system.

Residential, light commercial, commercial, and industrial HVAC systems are used to control temperatures and air quality in residences and buildings. Generally, the HVAC systems may circulate a refrigerant through a closed refrigeration circuit between an evaporator, where the refrigerant absorbs heat, and a condenser, where the refrigerant releases heat. The refrigerant flowing within the refrigeration circuit is circulated by a compressor to components of the refrigeration circuit such as heat exchangers. As such, the amount of refrigerant flowing through a heat exchanger determines a heating or cooling capacity of the heat exchanger. It is presently recognized that existing HVAC systems may operate at reduced efficiencies when a flow rate of refrigerant circulated through the HVAC system is relatively low.

SUMMARY

In one embodiment, the present disclosure relates to a heat exchanger system that includes a heat exchanger comprising a plurality of circuits wherein the heat exchanger is configured to exchange heat between a refrigerant and a working fluid. Further, the heat exchanger system includes a valve configured to fluidly couple a circuit of the plurality of circuits to a flow path of the refrigerant. Even further, the heat exchanger system includes a controller configured to receive feedback indicative of an operating parameter of the heat exchanger system, and wherein the controller is configured to actuate the valve based on the operating parameter.

In another embodiment, the present disclosure relates to a heating, ventilation, and air conditioning (HVAC) system includes a heat exchanger having a plurality of circuits configured to exchange heat between a refrigerant and a working fluid. Further, the HVAC system includes a compressor configured to circulate the refrigerant through the plurality of circuits of the heat exchanger. Even further, the HVAC system includes a controller configured to receive feedback indicative of a speed of the compressor, compare the feedback to a speed threshold range, and actuate a valve to fluidly couple a circuit of the plurality of circuits to a flow path of the refrigerant in response to a correlation between the feedback and the speed threshold range.

In another embodiment, the present disclosure relates to a tangible, non-transitory, computer-readable medium, comprising instructions executable by at least one processor of a controller for a heating, ventilation, and air conditioning (HVAC) system. The instructions when executed by the at least one processor, cause the at least one processor to receive feedback indicative of an operating parameter of the HVAC system. The instructions when executed by the at least one processor, also cause the at least one processor to compares the feedback to a threshold range. Further, the instructions when executed by the at least one processor, also cause the at least one processor to actuate a valve of a plurality of valves in response to determining that the feedback is outside of the threshold range, and the valve of the plurality of valves is configured to fluidly couple a circuit of a heat exchanger of the HVAC system to a refrigerant flow path.

Other features and advantages of the present application will be apparent from the following, more detailed description of the embodiments, taken in conjunction with the accompanying drawings, which illustrate, by way of example, the principles of the application.

DETAILED DESCRIPTION

Figure 1:
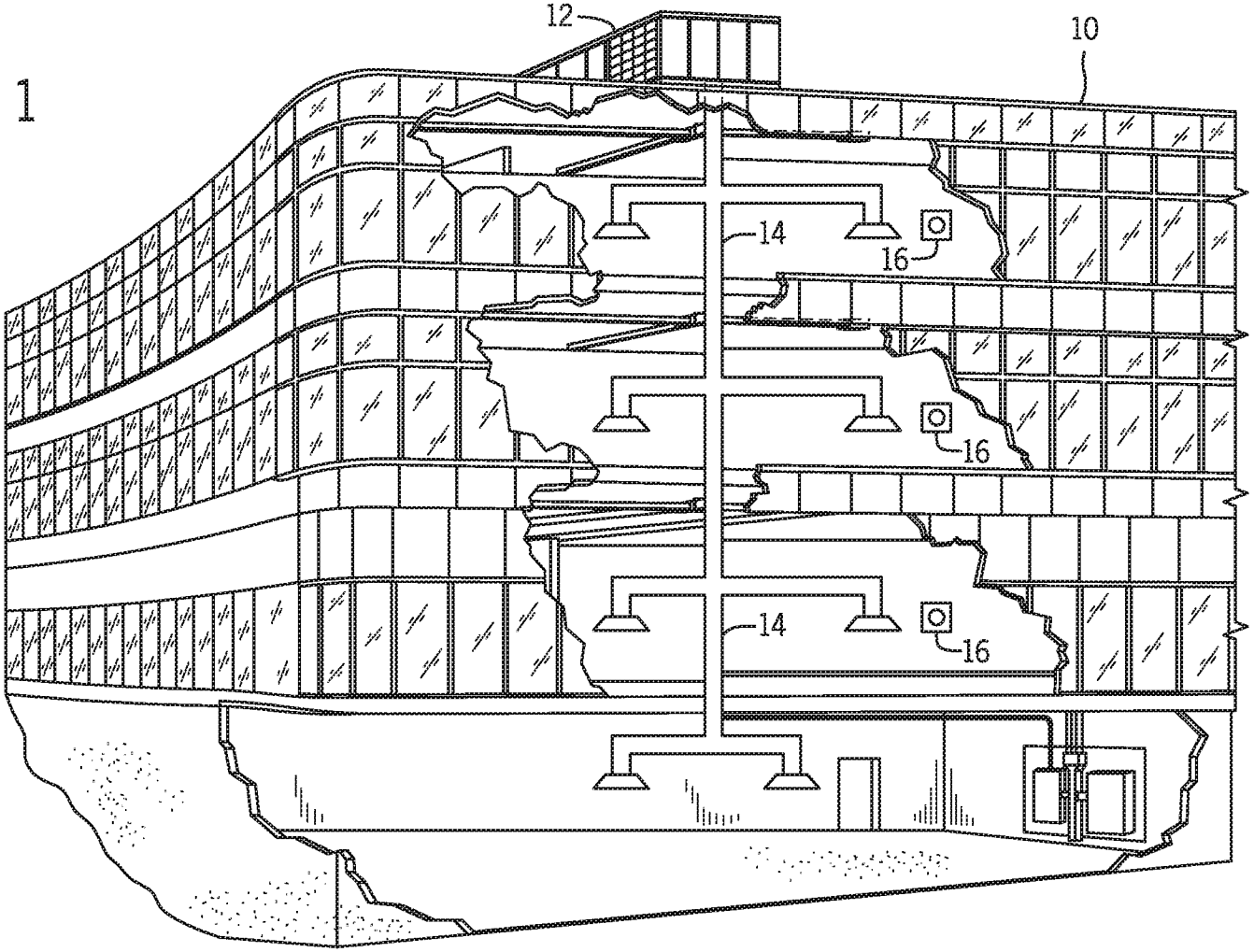
FIG. 1 is a perspective view of a commercial or industrial HVAC system, in accordance with aspects of the present disclosure.

As discussed above, a HVAC system generally includes a refrigerant flowing within a refrigeration circuit, also referred to herein as a vapor compression circuit or heat exchange circuit. The refrigerant flows through multiple conduits and components disposed along the refrigeration circuit, while undergoing phase changes to enable the HVAC system to condition an interior space of a structure. For example, a refrigerant may flow through a heat exchanger disposed along the refrigeration circuit. In some embodiments, the heat exchanger includes a plurality of circuits. Each circuit of the plurality of circuits may be fluidly coupled to a flow path of the refrigeration circuit, but isolate a flow of refrigerant through the heat exchanger with respect to the remaining circuits of the plurality of circuits. The refrigerant within each circuit of the plurality of circuits of the heat exchanger may be configured to exchange thermal energy with an air stream or another suitable working fluid.

A compressor is used to circulate refrigerant through the vapor compression circuit. In some embodiments, an operating speed of the compressor may be adjusted, which modifies an operating capacity of the HVAC system. As referred to herein, the operating capacity of the HVAC system is an ability of the HVAC system to carry out heating and/or cooling of the air steam. Increasing the operating speed of the compressor increases the circulation rate of the refrigerant through the refrigeration circuit, and thus, increases the operating capacity of the HVAC system. Thus, increasing the operating speed of the compressor may be desirable when there is a significant difference between a target temperature and a monitored temperature of the air stream used to condition a space within a structure. Similarly, decreasing the operating speed of the compressor may be desirable when the difference between a target temperature and the monitored temperature of the air stream is relatively small. In some cases, reducing the operating speed of the compressor below a threshold speed may reduce an efficiency of the HVAC system. For example, the reduced efficiency may be caused by inefficiently superheating, or an inability to properly superheat, a refrigerant discharged from the compressor and/or oil entrained in the refrigerant, which may cause blockage in the refrigerant circuit.

The present disclosure is directed to a variable capacity heat exchanger with an improved range of operating capacities. The heat exchanger includes the plurality of circuits, and each circuit may be selectively coupled to the refrigeration circuit to receive a refrigerant flow based on feedback indicative of an operating parameter of the HVAC system. The operating parameter may be a parameter indicative of the operating capacity or load of the HVAC system. For example, feedback indicative of a speed of the compressor may be used as an operating parameter. As such, one or more of the circuits may be fluidly coupled to the refrigeration circuit based on the compressor speed, which may improve the operating capacity, performance, and efficiency of the HVAC system.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes a HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
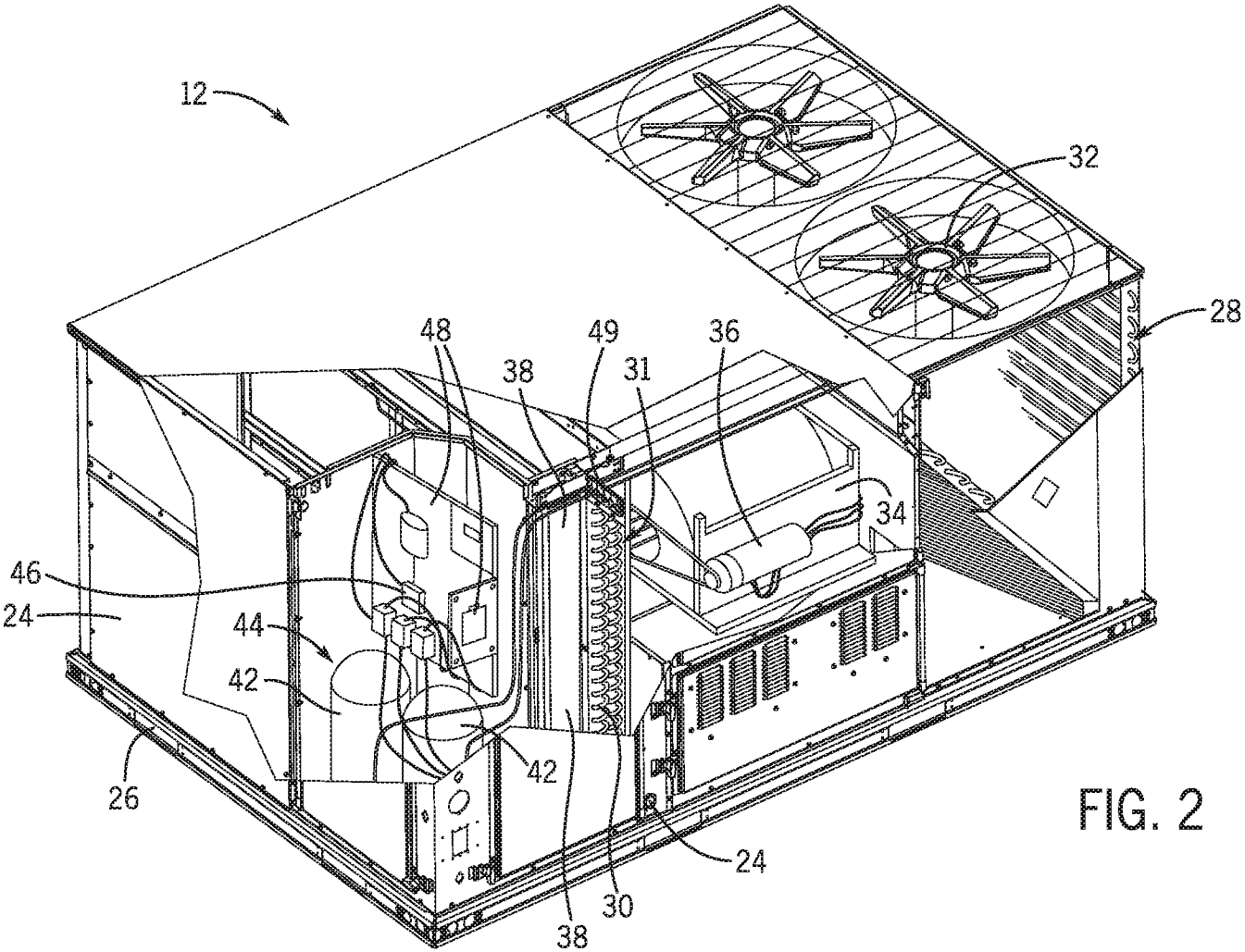
FIG. 2 is an illustration of an embodiment of a packaged unit of the HVAC system shown in FIG. 1, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
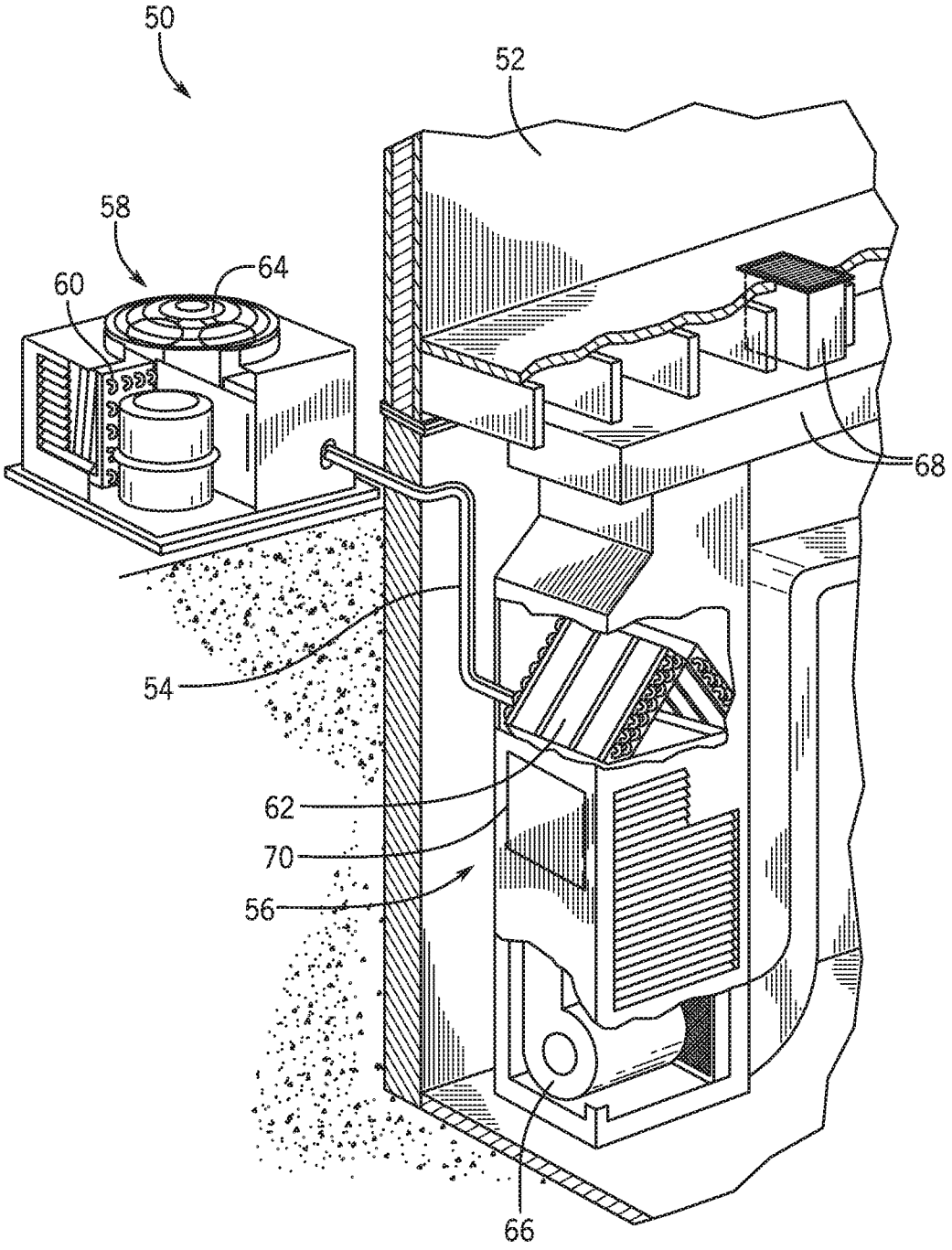
FIG. 3 is an illustration of an embodiment of a split system of the HVAC system shown in FIG. 1, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger that is, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
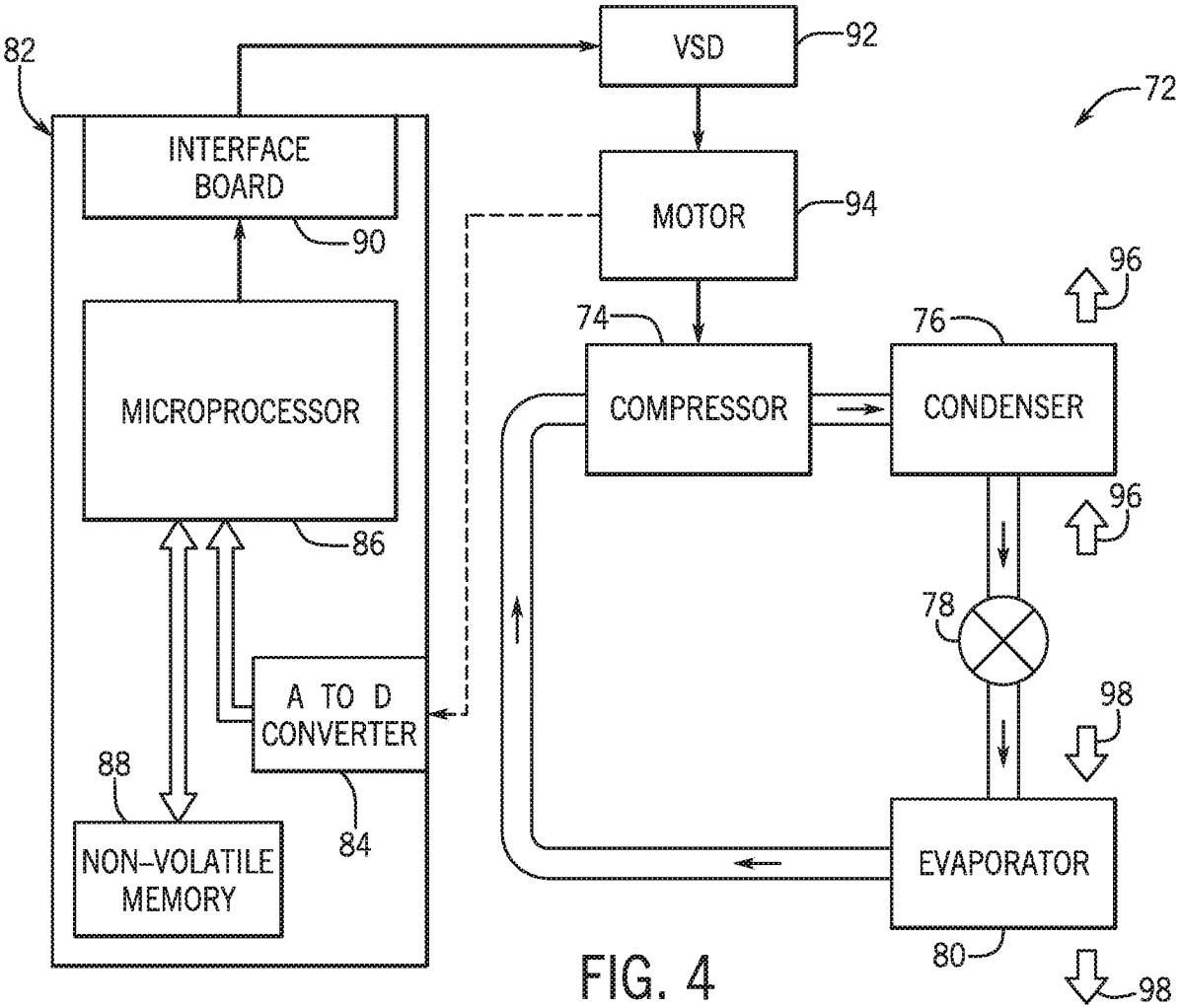
FIG. 4 is a schematic diagram of an embodiment of a refrigeration system of the HVAC system shown in FIG. 1, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

In some embodiments, it may be advantageous to include a variable capacity heat exchanger within a refrigeration circuit to improve the efficiency of an HVAC system, such as the HVAC unit and/or the residential heating and cooling system 50. As discussed above, the variable capacity heat exchanger may include a plurality of circuits, each coupled to a respective valve. A control system, such as the control panel 82, may selectively couple the valves to a refrigeration circuit based on feedback indicative of an operating parameter of the HVAC system, thereby providing additional or fewer heat exchange circuits to meet a load demand of the HVAC system. For example, the microprocessor 86 may couple additional heat exchange circuits to the heat exchanger based on a determination that the compressor is operating at a relatively high speed, which may be indicative of a demand for additional operating capacity of the heat exchanger and/or the HVAC system.

Figure 5:
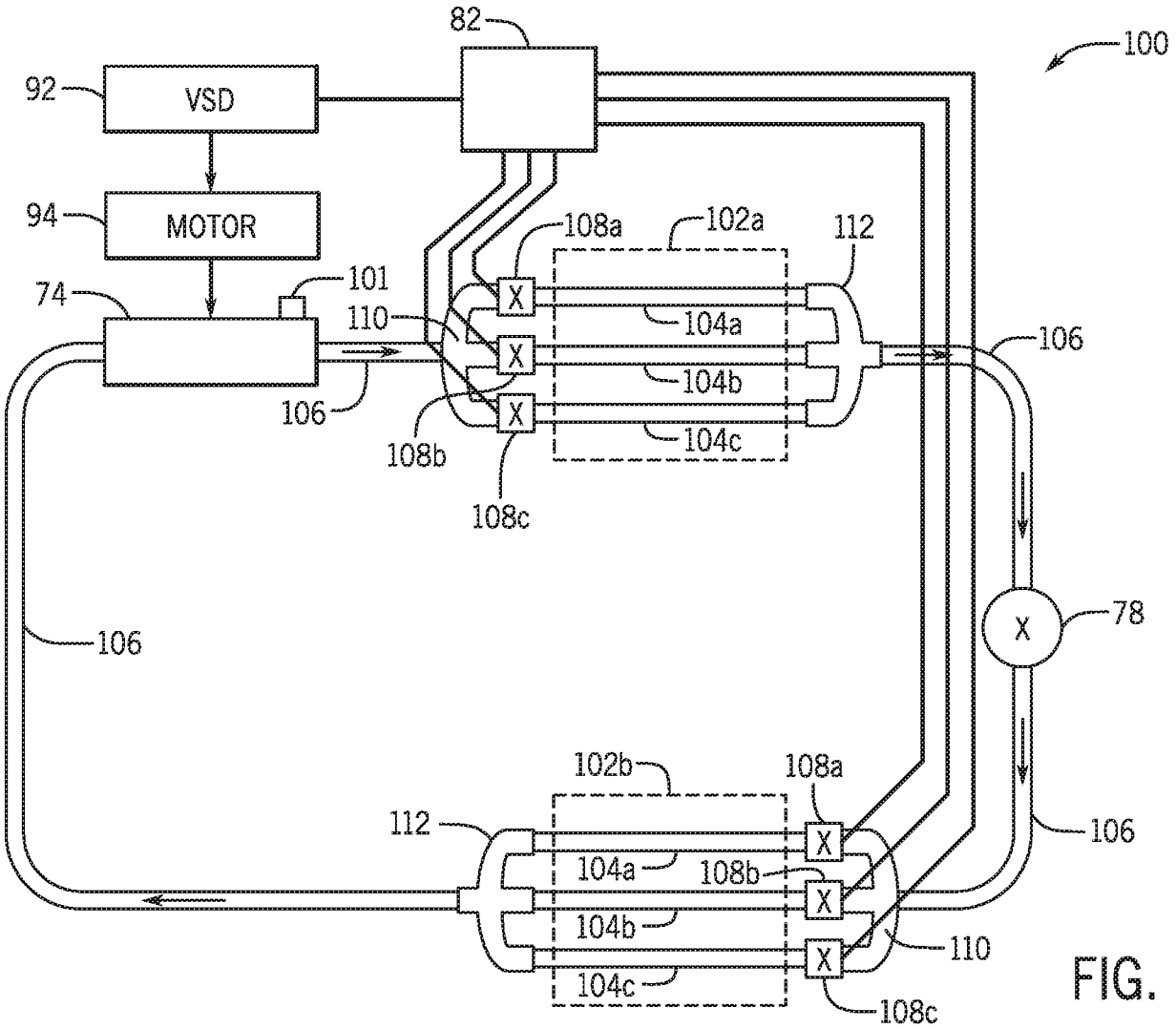
FIG. 5 is a schematic diagram of an embodiment of a refrigeration system of the HVAC system shown in FIG. 1, in accordance with aspects of the present disclosure.

FIG. 5 is a schematic illustrating an embodiment of a heat exchanger of a refrigeration system 100 that is communicatively coupled to the microprocessor 86 of the control panel 82 discussed above. In certain embodiments, the refrigeration system 100 may be the HVAC unit 12, the residential heating and cooling system 50, and/or the vapor compression system 72.

As shown in the illustrated embodiment of FIG. 5, the refrigeration system 100 includes two heat exchangers 102*a* and 102*b*. In some embodiments, the heat exchanger 102*a* may operate as a condenser and the heat exchanger 102*b* may operate as an evaporator. In other embodiments, the heat exchanger 102*a* operates as the evaporator and the heat exchanger 102*b* operates as the condenser. In any case, each of the heat exchangers 102*a* and 102*b* includes circuits 104 that may each be selectively coupled to a flow path of the refrigeration circuit 106 of the refrigeration system 100 via corresponding valves 108. As used herein, a flow path is a conduit directing the refrigerant between components of the refrigeration system 100 along a predetermined route. In certain embodiments, each heat exchanger 102*a* and 102*b* of the refrigeration system 100 may include two or more of the circuits 104 that are each configured to exchange heat between a refrigerant flowing in the respective circuit, and an air stream or other fluid medium flowing through or over the circuits 104. For example, the heat exchangers 102*a* and/or 102*b* may include two, three, four, five, or more of the circuits 104. As shown, each of the heat exchangers 102*a* and 102*b* includes three circuits 104*a*, 104*b*, and 104*c* that are each coupled to a respective valve 108*a*, 108*b*, and 108*c*. The heat exchanger 102, one or more circuits 104, and respective valves 108 are collectively referred to as a heat exchanger system that is part of the refrigeration system 100. Additionally, each of the circuits 104 shown in FIG. 5 are single-pass circuits, however, in other embodiments, one or more of the circuits 104 may be dual-pass or multi-pass circuits.

During operation, the refrigeration system 100 selectively couples one or more of the circuits 104*a*, 104*b*, and 104*c* to the refrigeration circuit 106 via the valves 108*a*, 108*b*, and 108*c* based on an operating parameter of the HVAC system, such as the operating speed of the compressor 74, and/or an operating parameter associated with the heat exchanger system. For instance, the control panel 82 may receive feedback indicative of compressor speed via a sensor 109 and selectively adjust a position of the valves 108*a*, 108*b*, and/or 108*c* based on the feedback. In certain embodiments, at least one of the circuits 104*a*, 104*b*, and 104*c* may not include a valve, and therefore, is an uninterrupted connection that enables refrigerant to continuously flow through the at least one circuit 104*a*, 104*b*, and/or 104*c* of the heat exchangers 102*a* and/or 102*b* during operating of the refrigeration system 100. In other embodiments, each of the circuits 104 includes a corresponding valve 108. In still further embodiments, a single valve 108 may fluidly couple multiple circuits 104 to the refrigeration circuit 106.

Figure 6:
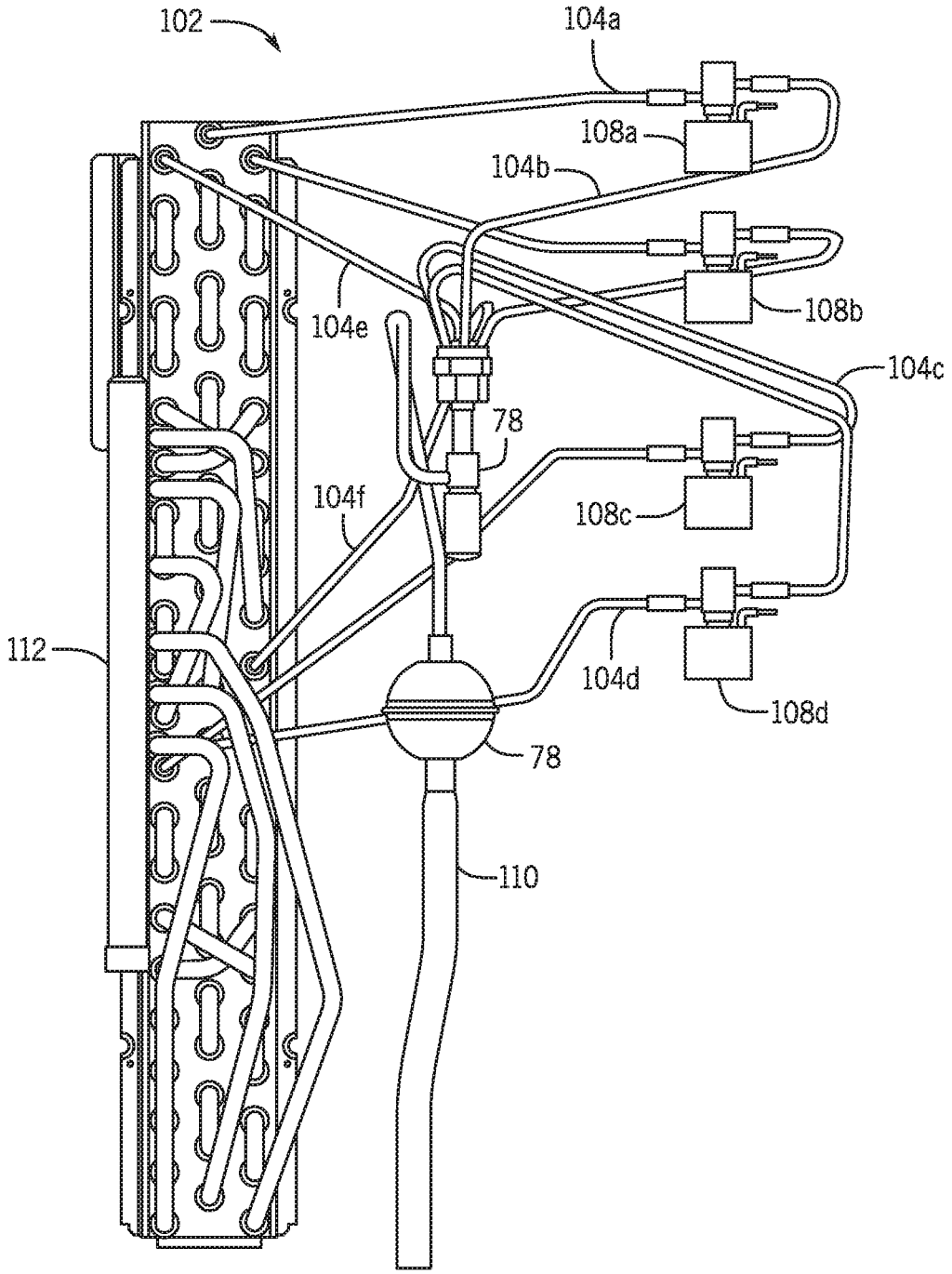
FIG. 6 is a schematic diagram of an embodiment of a heat exchanger of the refrigeration system FIG. 5, in accordance with aspects of the present disclosure.

FIG. 6 is an elevation view of an embodiment of a heat exchanger 102 in accordance with the present disclosure. As shown in the illustrated embodiment of FIG. 6, the heat exchanger includes six of the circuits 104. Four of the circuits 104*a*, 104*b*, 104*c*, and 104*d* include a respective valve 108*a*, 108*b*, 108*c*, and 108*d*. The valves 108*a*, 108*b*, 108*c*, and 108*d* are configured to selectively couple each respective circuit 104*a*, 104*b*, 104*c*, and 104*d* to an inlet 110 of the heat exchanger 102 that is coupled to the refrigeration circuit 106. Additionally, the heat exchanger 102 may include a manifold 112, or suction header, that collects refrigerant flowing through the individual circuits 104 and directs the flow of refrigerant from the heat exchanger 102 back to the refrigeration circuit 106.

In general, one or more of the circuits 104*a*, 104*b*, 104*c*, and 104*d* are fluidly coupled to the refrigeration circuit 106 in response to signals transmitted from the control panel 82 to the valves 108*a*, 108*b*, 108*c*, and 108*d*. As discussed herein, the signals may be transmitted based on feedback indicative of an operating parameter of the refrigeration system 100, such as compressor speed. A process for coupling each heat exchange circuit 104*a*, 104*b*, 104*c*, and 104*d* to the refrigeration circuit 106 is discussed in more detail herein with reference to FIGS. 7 and 8.

As discussed above, in some embodiments, the heat exchanger 102 also includes two circuits 104*e* and 104*f*, which do not have respective valves 108. As such, refrigerant continuously flows through circuits 104*e* and 104*f* of the heat exchanger 102 during operating of the refrigeration system 100. In other words, refrigerant may not be entirely blocked from flowing through the heat exchanger 102 during operation of the refrigeration system 100 because the circuits 104*e* and 104*f* may receive a flow of the refrigerant regardless of the feedback indicative of the operating parameter.

Figure 7:
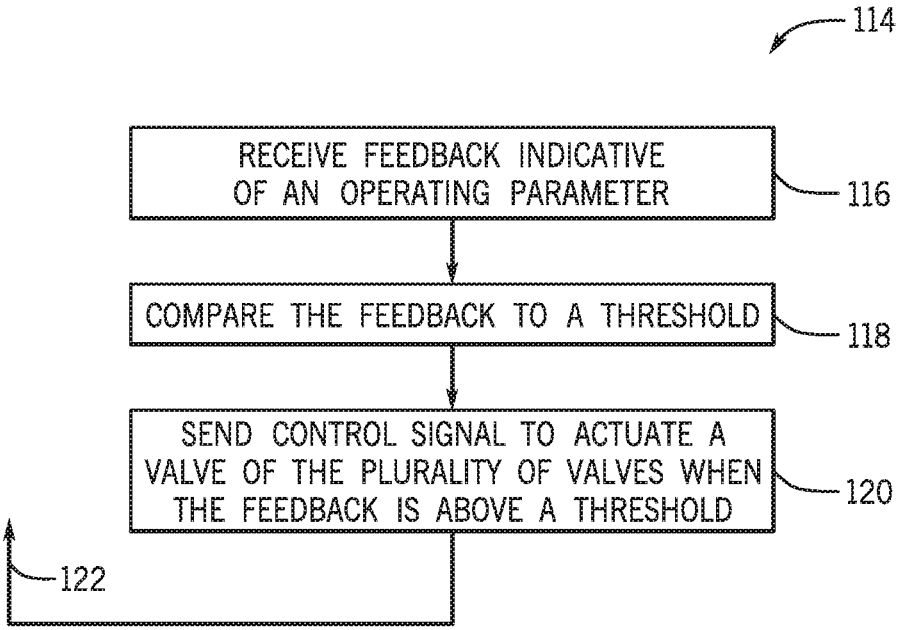
FIG. 7 is a flow chart representing an embodiment of a process for operating the heat exchanger shown in FIG. 5, in accordance with aspects of the present disclosure.

FIG. 7 is a flow chart illustrating an embodiment of a process 114 for operating the heat exchanger 102 of the refrigeration system 100, in accordance with the present disclosure. It is to be understood that the steps discussed herein are merely exemplary, and certain steps may be omitted or performed in a different order than the order described below. In some embodiments, the process 114 may be stored in the non-volatile memory 88 and executed by the microprocessor 86 of the control panel 82, or stored in other suitable memory and executed by other suitable processing circuitry associated with the refrigeration system 100 or separate, suitable processing circuitry.

As shown in the illustrated embodiment of FIG. 7, at block 116, the microprocessor 86 receives feedback indicative of an operating parameter of the HVAC system. As several non-limiting examples, the operating parameter may be the operating speed of the compressor, a temperature of the refrigerant, a pressure of the refrigerant, or any combination thereof. In general, the operating parameter may be any parameter that is indicative of the performance or capacity of the HVAC system. In some embodiments, using a combination of operating parameters may increase an accuracy of estimating the performance or capacity of the HVAC system.

When the feedback indicative of the operating parameter is received by the microprocessor 86, the microprocessor 86 compares the feedback to a threshold range, as indicated in block 116. The threshold range may be determined by an operator during the manufacturing of an HVAC system that includes the refrigeration system 100. Additionally or alternatively, the threshold may be determined through experimental testing and stored within the non-volatile memory 88 of the control panel 82. Further, the threshold range may be a threshold value. That is, the microprocessor may determine whether the feedback is greater than or less than the threshold value, rather than within a threshold range.

At block 120, the microprocessor 86 of the control panel 82 provides a suitable control signal to a valve, such as 108*a*, 108*b*, 108*c*, and 108*d* shown in FIG. 6. The control signals may actuate the valve to an open position to fluidly couple a corresponding circuit 104*a*, 104*b*, 104*c*, or 104*d* of the heat exchanger 102 to the refrigeration circuit 106 when the feedback is above the threshold or within the threshold range. As illustrated, when the microprocessor 86 determines that the feedback is above or within the threshold range, then the microprocessor 86 may return back to block 116 of the process 114, as indicated by the arrow 122. In some embodiments, the non-volatile memory 88 may store a plurality of threshold ranges and/or a plurality of threshold values. As such, the microprocessor may continue to actuate more of the valves 108*a*, 108*b*, 108*c*, and/or 108*d* of the refrigeration system 100 to the open position when the feedback is greater than a threshold value of the plurality of threshold values or within a given threshold range of the plurality of threshold ranges. The process 114 may continue to iteratively open the valves 108*a*, 108*b*, 108*c*, and 108*d*, until each valve 108*a*, 108*b*, 108*c*, and 108*d* of the refrigeration system 100 is open.

Additionally, the control signals provided to a valve, such as 108*a*, 108*b*, 108*c*, and 108*d*, may actuate that valve to a closed position, such that the valve fluidly decouples a corresponding circuit 104*a*, 104*b*, 104*c*, or 104*d* from the refrigeration circuit 106 when the feedback is below or outside of the threshold range. In other embodiments, when the microprocessor 86 determines that the feedback is outside of a first threshold range, the microprocessor 86 may then determine if the feedback is within a second threshold range. As such, the microprocessor 86 may continue to compare the feedback to each threshold range of the plurality of threshold ranges when the feedback is determined to be outside of a given threshold range.

Figure 8:
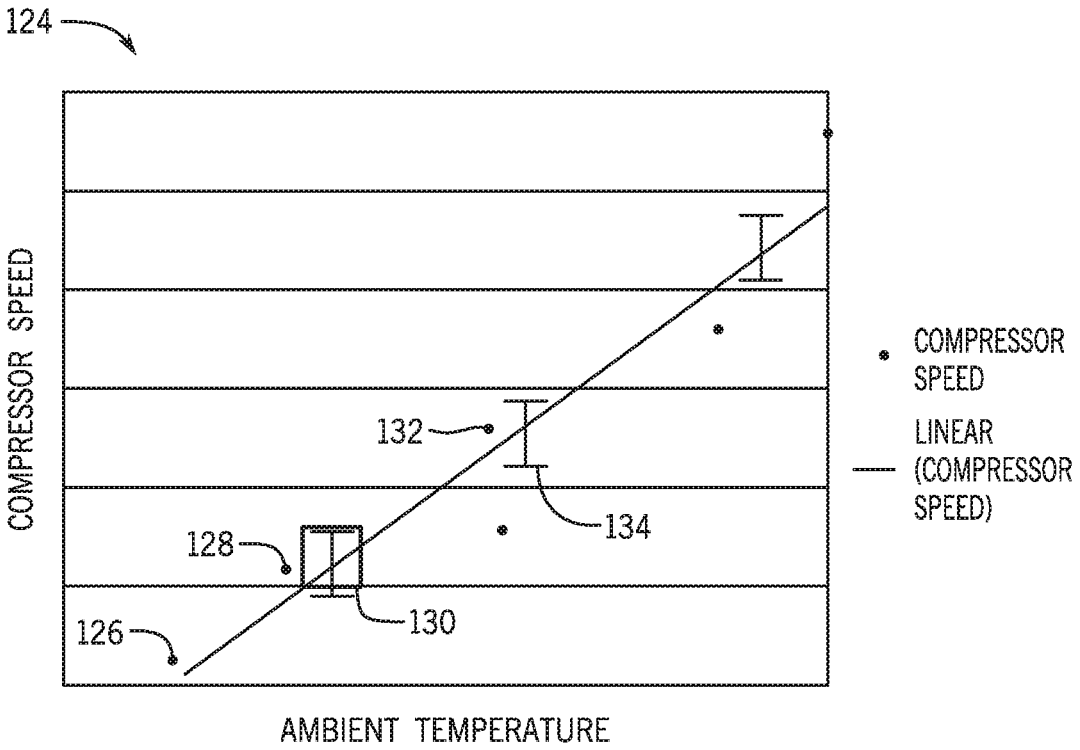
FIG. 8 shows a graph of compressor speed versus ambient temperature that may be utilized by the process shown in FIG. 7, in accordance with aspects of the present disclosure.

FIG. 8 shows a graph 124 of compressor speed versus ambient temperature, which may be illustrative of the process 114 for selectively directing a flow of refrigerant through a plurality of circuits of the heat exchanger 102 shown in FIG. 6. As used herein, the ambient temperature may include a temperature of an environment surrounding the refrigeration system 100 or at least a portion of the refrigeration system 100. As shown in the illustrated embodiment of FIG. 8, the compressor speed generally increases as the ambient temperature increases. As discussed above, the compressor speed may be used as an operating parameter to determine a number of the valves, such as 108*a*, 108*b*, 108*c*, and 108*d*, that may be open, and thus, fluidly coupling respective heat exchange circuits 104*a*, 104*b*, 104*c*, and 104*d* to the refrigeration circuit 106. Additionally, the compressor speed may be used as a parameter to determine a number of valves 108 to close, which fluidly decouples respective heat exchange circuits 104*a*, 104*b*, 104*c*, and 104*d* from the refrigeration circuit 106. As such, the microprocessor 86 determines whether to open or close the valves 108*a*, 108*b*, 108*c*, and 108*d* based on feedback received from the compressor 74 and/or a sensor providing feedback indicative of compressor speed.

For example, at point 126, the compressor speed may be operating near or at a low threshold value, or speed. That is, the low threshold value may be indicative of a speed that enables oil to remain substantially entrained in the refrigerant circulating through the refrigeration circuit 106 and also allow for suitable superheating of the refrigerant in the refrigeration circuit 106 when operating at relatively low ambient temperatures. As the ambient temperature increases, a higher compressor speed may be suitable for maintaining sufficient heating or cooling of the air stream by the refrigeration system 100. At point 128, the compressor speed is increased above the low threshold value to account for an increase in ambient temperature. A first threshold or threshold range 130 of the compressor speed may be determined by an operator and/or experimental testing. The first threshold or threshold range 130 may be indicative of a demand for an increased or decreased flow of refrigerant through the heat exchanger 102 to satisfy a capacity of the refrigeration system 100. As shown, point 128 is within a y-axis threshold range 130. As such, the compressor speed at point 128 is within the threshold range 130, and therefore, the microprocessor 86 of the control panel 82 may provide a control signal to actuate the valve 108*a*. In some embodiments, two or more valves 108 may open when the compressor speed is within the threshold 130. Moreover, the order for opening the valves 108 may be determined based on efficiency at which the heat exchanger 102 operates when one or more of the circuits 104 are active. For instance, the microprocessor 86 may determine which valve 108*a*, 108*b*, 108*c*, and/or 108*d* to open based on which corresponding circuit 104*a*, 104*b*, 104*c*, and/or 104*d* provides the greatest increase in efficiency to the heat exchanger 102. In other embodiments, the order for opening the valves 108 may be arbitrary or based on a position of the valves 108 with respect to one another.

At point 132, the compressor speed is outside of and above the first threshold range 130. Additionally, point 132 is within a second threshold range 134. As such, the microprocessor 86 may determine that feedback indicative of the operating parameter, which may be the compressor speed, is outside of and above the first threshold range 130. Thus, the microprocessor 86 will send suitable control signals to actuate an appropriate number of the valves 108*a*, 108*b*, 108*c*, and 108*d*. The microprocessor may either repeat the process 114 from block 116, or based on determining that point 132 is above the first threshold 130, compare point 132 to the second threshold range 134. As point 132 is within the second threshold, the microprocessor 86 sends a control signal to actuate an appropriate number of additional valves 108 from a closed position to an open position. In some embodiments, actuating the valves 108 may include partially opening and/or closing one or more valves.

In some embodiments, a buffer range may be included between two adjacent thresholds or threshold ranges to prevent frequent adjustment of the valves. For example, as shown in the illustrated embodiment in FIG. 8, the first threshold range 130 and the second threshold range 134 span a nearly continuous range of compressor speeds, such that an upper threshold of the first threshold range 130 is substantially equal to a lower threshold of the second threshold range 132. When feedback indicative of the compressor speed is between or proximate to both the first threshold range 130 and the second threshold range 134, one or more of the valves may undergo frequent adjustments between an open and closed position due to relatively small fluctuations in compressor speed. As such, it may be advantageous to include a buffer range between two threshold ranges or threshold values. When feedback is within the buffer range, the microprocessor 86 may not send a control signal to actuate one of the valves, such that the microprocessor 86 does not repeat a previous instruction or reverse a previous instruction to close, open, and/or partially open or close one or more valves. Instead, the microprocessor 86 may enable each of the valves 108 to maintain a position when the feedback is within the buffer range.

The present disclosure is directed to a variable capacity heat exchanger that improves the efficiency of a refrigeration circuit. The variable capacity heat exchanger includes a plurality of circuits, which may be coupled to a respective valve. A control system may actuate the valves to fluidly couple the circuits to a refrigeration circuit based on feedback indicative of an operating parameter of the HVAC system, thereby providing additional or fewer heat exchange circuits to meet a load demand of the HVAC system. For example, the microprocessor 86 may couple additional heat exchange circuits to the heat exchanger based on a determination that the compressor is operating at a sufficiently high speed, which may be indicative of a demand for additional operating capacity of the heat exchanger or the HVAC system.

While only certain features and embodiments of the present disclosure have been illustrated and described, many modifications and changes may occur to those skilled in the art. For example, modifications may include variations in sizes, dimensions, structures, shapes and proportions of the various elements, values of parameters, mounting arrangements, use of materials, and orientations, without materially departing from the novel teachings and advantages of the subject matter recited in the claims. The order or sequence of any process or method steps may be varied or resequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described. For example, those unrelated to the presently contemplated best mode of carrying out of the disclosure, or those unrelated to enabling the claim features may not have been described It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger system, comprising:

a heat exchanger comprising a plurality of conduits, wherein each conduit of the plurality of conduits is configured to receive refrigerant from a refrigerant flow path of the heat exchanger system, wherein a first conduit of the plurality of conduits is fluidly coupled to the refrigerant flow path via an uninterrupted connection, and wherein the heat exchanger is an indoor heat exchanger;

an expansion valve disposed along the refrigerant flow path and configured to receive the refrigerant;

a valve fluidly coupled between a second conduit of the plurality of conduits and the expansion valve relative to a direction of refrigerant flow along the refrigerant flow path, wherein the valve is configured to receive the refrigerant from the expansion valve and adjust a flow of the refrigerant to the second conduit; and a controller configured to receive feedback indicative of a capacity parameter associated with the heat exchanger system, and wherein the controller is configured to actuate the valve based on the capacity parameter.

2. The heat exchanger system of claim 1, wherein the controller is configured to actuate the valve, an additional valve, or both, such that the flow of the refrigerant is directed to each conduit of the plurality of conduits, or a set of conduits of the plurality of conduits, based on the capacity parameter associated with the heat exchanger system.

3. The heat exchanger system of claim 1, wherein the controller is configured to sequentially fluidly couple two or more of the plurality of conduits to the refrigerant flow path via a set order.

4. The heat exchanger system of claim 1, wherein the valve is a solenoid valve.

5. The heat exchanger system of claim 1, wherein the controller is configured to actuate the valve based on a comparison of the capacity parameter to a threshold range.

6. The heat exchanger system of claim 1, wherein the capacity parameter is a speed of a compressor.

7. The heat exchanger system of claim 1, wherein the capacity parameter is a pressure of the refrigerant.

8. The heat exchanger system of claim 1, wherein the capacity parameter is a temperature of the refrigerant.

9. The heat exchanger system of claim 1, wherein the plurality of conduits is configured to direct the refrigerant through the indoor heat exchanger in a parallel flow configuration.

10. The heat exchanger system of claim 1, wherein the controller is configured to actuate the valve to block the flow of the refrigerant to the second conduit of the plurality of conduits based on the capacity parameter.

11. A heating, ventilation, and air conditioning (HVAC) system, comprising:

an indoor heat exchanger comprising a plurality of conduits, wherein each conduit of the plurality of conduits is configured to receive refrigerant from a refrigerant flow path of the HVAC system, wherein a first conduit of the plurality of conduits is fluidly coupled to the refrigerant flow path via an uninterrupted connection;

an expansion valve disposed along the refrigerant flow path and configured to direct the refrigerant to each conduit of the plurality of conduits;

a compressor configured to circulate the refrigerant through the expansion valve and the plurality of conduits of the indoor heat exchanger; and a controller configured to:

receive feedback indicative of a speed of the compressor;

compare the feedback to a speed threshold range; and actuate a valve positioned downstream of the expansion valve and upstream of a second conduit of the plurality of conduits to adjust a flow of the refrigerant to the second conduit of the plurality of conduits in response to a correlation between the feedback and the speed threshold range.

12. The HVAC system of claim 11, wherein the controller is configured to:

receive additional feedback indicative of an additional speed of the compressor;

compare the additional feedback to an additional speed threshold range; and actuate an additional valve to adjust a flow of the refrigerant to a third conduit of the plurality of conduits in response to determining that the additional feedback is outside of the additional speed threshold range.

13. The HVAC system of claim 11, wherein the controller is configured to actuate the valve and an additional valve to adjust the flow of the refrigerant to the second conduit of the plurality of conduits and to a third conduit of the plurality of conduits in response to determining that the feedback is outside of the speed threshold range.

14. The HVAC system of claim 11, wherein the controller is configured to close, or partially close, the valve in response to determining that the feedback is outside of and below the speed threshold range.

15. A tangible, non-transitory, computer-readable medium, comprising instructions executable by at least one processor of a controller for a heating, ventilation, and air conditioning (HVAC) system that, when executed by the at least one processor, cause the at least one processor to:

receive feedback indicative of a capacity parameter of the HVAC system;

compare the feedback to a threshold range; and in response to determining that the feedback is outside of the threshold range, actuate a valve of a plurality of valves positioned downstream of an expansion valve disposed along a refrigerant flow path and positioned upstream of a conduit of an indoor heat exchanger having a plurality of conduits including the conduit and an additional conduit that is fluidly coupled to the refrigerant flow path via an uninterrupted connection, wherein the valve of the plurality of valves is configured to adjust a flow of refrigerant from the refrigerant flow path to the conduit.

16. The tangible, non-transitory, computer-readable medium of claim 15, wherein the instructions, when executed by the at least one processor, cause the at least one processor to:

receive additional feedback indicative of the capacity parameter of the HVAC system when the feedback is outside of the threshold range;

compare the additional feedback to an additional threshold range; and actuate an additional valve of the plurality of valves in response to determining that the additional feedback is outside the additional threshold range, wherein the conduit is a first conduit of the plurality of conduits, the additional conduit is a second conduit of the plurality of conduits, and wherein the additional valve of the plurality of valves is configured to adjust a flow of the refrigerant to a third-conduit of the plurality of conduits.

17. The tangible, non-transitory, computer-readable medium of claim 15, wherein the instructions, when executed by the at least one processor, cause the at least one processor to close the valve to block the flow of refrigerant to the conduit in response to determining the feedback is outside of the threshold range.

18. The tangible, non-transitory, computer-readable medium of claim 15, wherein the instructions, when executed by the at least one processor, cause the at least one processor to maintain a position of the valve when the feedback is within a buffer range.

19. The tangible, non-transitory, computer-readable medium of claim 15, wherein the instructions, when executed by the at least one processor, cause the at least one processor to partially open or partially close the valve.

20. The HVAC system of claim 11, further comprising an additional heat exchanger fluidly coupled to the refrigerant flow path and configured to receive the refrigerant from the indoor heat exchanger, wherein the additional heat exchanger comprises an additional plurality of conduits associated with an additional plurality of valves configured to adjust refrigerant flow through the additional plurality of conduits.

21. The HVAC system of claim 20, wherein the valve is one of a plurality of valves associated with a subset of the plurality of conduits, wherein the plurality of valves is configured to adjust the flow of the refrigerant through the subset of the plurality of conduits, and wherein the controller is configured to actuate corresponding valve sets of the plurality of valves and the additional plurality of valves in response to the correlation between the feedback and the speed threshold range, wherein each of the corresponding valve sets includes a respective one of the plurality of valves and a respective one of the additional plurality of valves.

* * * * *